US009574822B2

(12) United States Patent
Haberberger et al.

(10) Patent No.: US 9,574,822 B2
(45) Date of Patent: Feb. 21, 2017

(54) LIQUEFIED NATURAL GAS FACILITY EMPLOYING AN OPTIMIZED MIXED REFRIGERANT SYSTEM

(71) Applicant: Black & Veatch Corporation, Overland Park, KS (US)

(72) Inventors: Kyle M. Haberberger, Lees Summit, MO (US); Jason M. Manning, Overland Park, KS (US); Shawn D. Hoffart, Overland Park, KS (US)

(73) Assignee: Black & Veatch Corporation, Overland Park, KS (US)

( * ) Notice: Subject to any disclaimer, the term of this patent is extended or adjusted under 35 U.S.C. 154(b) by 299 days.

(21) Appl. No.: 14/215,114

(22) Filed: Mar. 17, 2014

(65) Prior Publication Data

US 2015/0260451 A1 Sep. 17, 2015

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0055* (2013.01); *F25J 1/0212* (2013.01); *F25J 1/0214* (2013.01); *F25J 1/0217* (2013.01); *F25J 1/0262* (2013.01); *F25J 1/0279* (2013.01); *F25J 1/0291* (2013.01); *F25J 2220/64* (2013.01); *F25J 2270/12* (2013.01); *F25J 2270/14* (2013.01); *F25J 2270/16* (2013.01); *F25J 2270/66* (2013.01); *F25J 2290/32* (2013.01)

(58) Field of Classification Search
CPC ..... F25J 1/0214; F25J 1/0217; F25J 1/0212; F25J 2270/66; F25J 1/0022; F25J 2270/12; F25J 2270/14; F25J 2270/16; F25J 1/0052; F25J 1/029; F25J 1/0291; F25J 1/0055
See application file for complete search history.

(56) References Cited

U.S. PATENT DOCUMENTS

| | | | |
|---|---|---|---|
| 2,976,695 | A | 10/1961 | Meade |
| 3,191,395 | A | 6/1965 | Maher et al. |
| 3,210,953 | A | 10/1965 | Reed |
| 3,271,967 | A | 9/1966 | Karbosky |
| 3,596,472 | A | 8/1971 | Streich |
| 3,729,944 | A | 5/1973 | Kelley et al. |
| 3,800,550 | A | 4/1974 | Delahunty |

(Continued)

FOREIGN PATENT DOCUMENTS

| | | |
|---|---|---|
| CN | 201463463 U | 5/2010 |
| JP | 200018049 | 1/2000 |
| JP | 20025398 | 1/2002 |
| JP | 2003232226 | 8/2003 |
| WO | 2005045338 | 5/2005 |
| WO | WO2009151418 A1 | 12/2009 |

OTHER PUBLICATIONS

International Search Report and Written Opinion for PCT/US2015/016551 dated May 22, 2015, 8 pages.

(Continued)

*Primary Examiner* — Keith Raymond
(74) *Attorney, Agent, or Firm* — Hovey Williams LLP

(57) ABSTRACT

Processes and systems for producing liquefied natural gas (LNG) with a single mixed refrigerant, closed-loop refrigeration cycle are provided. Liquefied natural gas facilities configured according to embodiments of the present invention include refrigeration cycles optimized to provide increased efficiency and enhanced operability, with minimal additional equipment or expense.

13 Claims, 3 Drawing Sheets

(56) References Cited

U.S. PATENT DOCUMENTS 3,932,154 A 1/1976 Coers et al.
4,033,735 A 7/1977 Swenson
4,036,028 A 7/1977 Mandrin
4,217,759 A 8/1980 Shenoy
4,249,387 A 2/1981 Crowley
4,311,496 A 1/1982 Fabian
4,411,677 A 10/1983 Pervier et al.
4,525,187 A 6/1985 Woodward et al.
4,584,006 A 4/1986 Apffel
4,662,919 A 5/1987 Davis
4,676,812 A 6/1987 Kummann
4,707,170 A 11/1987 Ayres et al.
4,714,487 A 12/1987 Rowles
4,720,294 A 1/1988 Lucadamo et al.
4,727,723 A 3/1988 Durr
4,869,740 A 9/1989 Campbell et al.
4,878,932 A 11/1989 Phade et al.
5,051,120 A 9/1991 Pahade et al.
5,148,680 A 9/1992 Dray
5,182,920 A 2/1993 Matsuoka et al.
5,275,005 A 1/1994 Campbell et al.
5,351,491 A 10/1994 Fabian
5,377,490 A 1/1995 Howard et al.
5,379,597 A 1/1995 Howard et al.
5,398,497 A 3/1995 Suppes
5,497,626 A 3/1996 Howard et al.
5,502,972 A 4/1996 Howard et al.
5,555,748 A 9/1996 Campbell et al.
5,566,554 A 10/1996 Vijayaraghavan et al.
5,568,737 A 10/1996 Campbell et al.
5,596,883 A 1/1997 Bernhard et al.
5,615,561 A 4/1997 Houshmand et al.
5,657,643 A * 8/1997 Price ..... F25B 1/10 62/612
5,771,712 A 6/1998 Campbell et al.
5,791,160 A 8/1998 Mandler et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,950,453 A 9/1999 Bowen et al.
5,979,177 A 11/1999 Sumner et al.
5,983,664 A 11/1999 Campbell et al.
5,983,665 A 11/1999 Howard et al.
5,992,175 A 11/1999 Yao et al.
6,003,603 A 12/1999 Breivik et al.
6,021,647 A 2/2000 Ameringer et al.
6,023,942 A 2/2000 Thomas et al.
6,035,651 A 3/2000 Carey
6,053,008 A 4/2000 Arman et al.
6,070,430 A 6/2000 McNeil et al.
6,085,546 A 7/2000 Johnston
6,105,390 A 8/2000 Bingham et al.
6,112,550 A 9/2000 Bonaquist et al.
6,182,469 B1 2/2001 Campbell et al.
6,260,380 B1 7/2001 Arman et al.
6,266,977 B1 7/2001 Howard et al.
6,295,833 B1 10/2001 Hoffart et al.
6,298,688 B1 * 10/2001 Brostow ..... F25J 1/0012 62/613
6,311,516 B1 11/2001 Key et al.
6,311,519 B1 11/2001 Gourbier et al.
6,330,811 B1 12/2001 Arman et al.
6,347,531 B1 * 2/2002 Roberts ..... F25J 1/0212 62/612
6,363,728 B1 4/2002 Udischas et al.
6,367,286 B1 4/2002 Price
6,401,486 B1 6/2002 Lee et al.
6,405,561 B1 6/2002 Mortko et al.
6,412,302 B1 7/2002 Foglietta
6,425,263 B1 7/2002 Bingham et al.
6,425,266 B1 7/2002 Roberts
6,427,483 B1 8/2002 Rashad et al.
6,438,994 B1 8/2002 Rashad et al.
6,449,982 B1 9/2002 Fischer
6,449,983 B2 9/2002 Pozivil
6,460,350 B2 10/2002 Johnson et al.
6,560,989 B1 5/2003 Roberts et al.
6,578,379 B2 6/2003 Paradowski
6,581,410 B1 6/2003 Johnson et al.
6,662,589 B1 12/2003 Roberts et al.
6,725,688 B2 4/2004 Elion et al.
6,745,576 B1 6/2004 Granger
6,823,691 B2 11/2004 Ohta
6,823,692 B1 11/2004 Patel et al.
6,915,662 B2 7/2005 Wilkinson et al.
6,925,837 B2 8/2005 Eaton
6,945,075 B2 9/2005 Wilkinson et al.
7,051,553 B2 5/2006 Mak et al.
7,069,744 B2 7/2006 Patel et al.
7,100,399 B2 9/2006 Eaton
7,107,788 B2 9/2006 Patel et al.
7,114,342 B2 10/2006 Oldham et al.
7,152,428 B2 12/2006 Lee et al.
7,152,429 B2 12/2006 Paradowski
7,159,417 B2 1/2007 Foglietta et al.
7,191,617 B2 3/2007 Cuellar et al.
7,204,100 B2 4/2007 Wilkinson et al.
7,210,311 B2 5/2007 Wilkinson et al.
7,216,507 B2 5/2007 Cuellar et al.
7,219,513 B1 5/2007 Mostafa
7,234,321 B2 6/2007 Maunder et al.
7,234,322 B2 6/2007 Hahn et al.
7,266,975 B2 9/2007 Hupkes et al.
7,310,972 B2 12/2007 Yoshida et al.
7,316,127 B2 1/2008 Huebel et al.
7,357,003 B2 4/2008 Ohara et al.
7,484,385 B2 2/2009 Patel et al.
7,614,241 B2 11/2009 Mostello
7,644,676 B2 1/2010 Lee et al.
7,713,497 B2 5/2010 Mak
7,793,517 B2 9/2010 Patel et al.
7,818,979 B2 10/2010 Patel et al.
7,841,288 B2 11/2010 Lee et al.
7,856,847 B2 12/2010 Patel et al.
8,505,312 B2 8/2013 Mak et al.
8,549,876 B2 10/2013 Kaart et al.
8,650,906 B2 2/2014 Price et al.
8,671,699 B2 3/2014 Rosetta et al.
2002/0166336 A1 11/2002 Wilkinson et al.
2003/0029190 A1 2/2003 Trebble
2003/0046953 A1 3/2003 Elion et al.
2004/0159122 A1 8/2004 Patel et al.
2005/0056051 A1 3/2005 Roberts et al.
2005/0204625 A1 9/2005 Briscoe et al.
2006/0260355 A1 11/2006 Roberts et al.
2006/0260358 A1 11/2006 Kun
2007/0157663 A1 7/2007 Mak et al.
2007/0231244 A1 10/2007 Shah et al.
2008/0264076 A1 10/2008 Price et al.
2009/0193846 A1 8/2009 Foral et al.
2009/0205367 A1 8/2009 Price
2009/0217701 A1 9/2009 Minta et al.
2010/0043488 A1 2/2010 Mak et al.
2010/0064725 A1 3/2010 Chieng et al.
2010/0132405 A1 6/2010 Nilsen
2011/0289963 A1 12/2011 Price
2012/0000245 A1 1/2012 Currence et al.
2012/0090324 A1 4/2012 Rosetta et al.
2012/0137726 A1 * 6/2012 Currence ..... F25J 3/0209 62/613
2013/0213807 A1 8/2013 Hanko et al.

OTHER PUBLICATIONS

Gas Processors Suppliers Association (GPSA) Engineering Databook, Section 16, "Hydrocarbon Recovery," p. 16-13 through 16-20, 12th ed. (2004).

* cited by examiner

LIQUEFIED NATURAL GAS FACILITY EMPLOYING AN OPTIMIZED MIXED REFRIGERANT SYSTEM

BACKGROUND

1. Technical Field

One or more embodiments of the present invention generally relate to systems and processes for cooling a feed gas stream with a single closed-loop mixed refrigerant cycle.

2. Description of Related Art

In recent years, natural gas has become a widely used source of fuel. In addition to its clean burning qualities and convenience, advances in exploration and production technology have permitted previously unreachable gas reserves to become accessible. Because many of these previously unreachable sources of natural gas are remote and are not connected to commercial markets or infrastructure by pipeline, cryogenic liquefaction of natural gas for transportation and storage has become increasingly important. In addition, liquefaction permits long term storage of natural gas, which can help balance out periodic fluctuations in supply and demand.

Several methods for liquefying natural gas are currently in practice. Although the specific configuration and/or operation of each facility may vary depending on, for example, the type of refrigeration system used, the rate and composition of feed gas, and other factors, most commercial facilities generally include similar basic components. For example, most facilities typically include a pretreatment area for removing one or more impurities from the incoming gas stream, a liquefaction zone for liquefying the gas stream, a refrigeration system for providing refrigeration to the liquefaction zone, and a storage and/or loading area for receiving, storing, and transporting the final liquefied product. Overall, the cost to construct and operate these facilities can vary widely, but in general, the cost of the refrigeration portion of the plant can account for up to 30 percent or more of the overall cost of the facility.

Thus, a need exists for an optimized refrigeration system capable of efficiently producing a liquefied gas product at a desired capacity, but with minimum amount of equipment. Ideally, the refrigeration system would be both robust and operationally flexible in order to handle variations in feed gas composition and flow rate, while still requiring minimal capital outlay and operating at the lowest possible cost.

SUMMARY

One embodiment of the present invention concerns a process for producing liquefied natural gas (LNG). The process comprises the following steps: (a) cooling a natural gas stream in a first heat exchanger to provide a cooled natural gas stream; (b) compressing a mixed refrigerant stream to provide a compressed refrigerant stream; (c) cooling and at least partially condensing the compressed refrigerant stream to provide a two-phase refrigerant stream; (d) separating the two-phase refrigerant stream into a first refrigerant vapor stream and a first refrigerant liquid stream in a first vapor-liquid separator; (e) combining at least a portion of the first refrigerant vapor stream withdrawn from the first vapor-liquid separator with at least a portion of the first refrigerant liquid stream to provide a combined refrigerant stream; (f) cooling at least a portion of the combined refrigerant stream to provide a cooled combined refrigerant stream; (g) separating the cooled combined refrigerant stream into a second refrigerant vapor stream and a second refrigerant liquid stream in a second vapor-liquid separator; (h) dividing the second refrigerant liquid stream into a first refrigerant liquid fraction and a second refrigerant liquid fraction; (i) cooling at least a portion of the first and second refrigerant liquid fractions to provide respective first and second cooled liquid refrigerant fractions; and (j) introducing the first and second cooled liquid refrigerant fractions into separate inlets of the first heat exchanger, wherein the first and second cooled liquid refrigerant fractions are used to carry out at least a portion of the cooling of step (a).

Another embodiment of the present invention concerns a process for producing a liquefied gas stream. The process comprises the following steps: (a) compressing a stream of mixed refrigerant in a first compression stage of a compressor to provide a first compressed refrigerant stream; (b) cooling and at least partially condensing the first compressed refrigerant stream to provide a cooled, compressed refrigerant stream; (c) separating the cooled, compressed refrigerant stream into a first refrigerant vapor stream and a first refrigerant liquid stream; (d) compressing the first refrigerant vapor stream in a second compression stage of the compressor to provide a second compressed refrigerant stream; (e) cooling and at least partially condensing at least a portion of the second compressed refrigerant stream to provide a partially condensed refrigerant stream; (f) separating the partially condensed refrigerant into a second refrigerant vapor stream, a second refrigerant liquid stream, and a third refrigerant liquid stream; (g) cooling the second and third refrigerant liquid streams to provide respective cooled second and third refrigerant liquid streams; (h) expanding at least one of the cooled second and cooled third refrigerant liquid streams to provide at least one cooled, expanded refrigerant stream; (i) cooling a feed gas stream via indirect heat exchange with the at least one cooled, expanded refrigerant stream to provide a cooled feed gas stream and at least one warmed refrigerant stream.

Yet another embodiment of the present invention concerns a system for cooling a natural gas stream. The system comprises a first heat exchanger for cooling a natural gas feed stream. The first heat exchanger comprises a first cooling pass having a feed gas inlet and a cool natural gas outlet, a second cooling pass for receiving and cooling a first stream of refrigerant liquid, wherein the second cooling pass has a first warm refrigerant inlet and a first cool refrigerant outlet; a third cooling pass for receiving and cooling a second stream of refrigerant liquid, wherein the third cooling pass has a second warm refrigerant inlet and a second cool refrigerant outlet; a first warming pass for receiving and warming a first stream of cooled refrigerant, wherein the first warming pass has a first cool refrigerant inlet and a first warm refrigerant outlet; and a second warming pass for receiving and warming a second stream of cooled refrigerant liquid, wherein the second warming pass has a second cool refrigerant inlet and a second warm refrigerant outlet. The first cool refrigerant outlet of the second cooling pass is in fluid flow communication with the first cool refrigerant inlet of the first warming pass, and the second cool refrigerant outlet of the third cooling pass is in fluid flow communication with the second cool refrigerant inlet of the second warming pass. The system also comprises at least one compressor for receiving and pressurizing a stream of mixed refrigerant. The compressor has a low pressure inlet and a high pressure outlet and the low pressure inlet is in fluid flow communication with at least one of the first warm refrigerant outlet of the first warming pass and the second warm refrigerant outlet of the second warming pass. The system also comprises a first cooler for cooling the pressurized stream of mixed refrigerant. The first cooler has a first warm fluid inlet and a first cool fluid outlet and the first warm fluid inlet is in fluid flow communication with the high pressure outlet of the compressor. The system also comprises a first vapor-liquid separator for separating a portion of the cooled refrigerant stream. The vapor-liquid separator comprises a first fluid inlet, a first vapor outlet, and a first liquid outlet and the first fluid inlet of the first vapor-liquid separator is in fluid flow communication with the first cool fluid outlet of the first cooler. The system also comprises a first liquid conduit for transporting at least a portion of the liquid exiting the first vapor-liquid separator. The first liquid conduit has a refrigerant liquid inlet and a pair of refrigerant liquid outlets. The refrigerant liquid inlet is in fluid flow communication with the first liquid outlet of the first vapor-liquid separator. One of the pair of refrigerant liquid outlets is in fluid flow communication with the first warm refrigerant inlet of the second cooling pass and the other of the pair of refrigerant liquid outlets is in fluid flow communication with the second warm refrigerant inlet of the third cooling pass.

BRIEF DESCRIPTION OF THE DRAWINGS

Various embodiments of the present invention are described in detail below with reference to the attached Figures, wherein.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

The present invention generally relates to processes and systems for liquefying a natural gas feed stream to thereby provide a liquefied natural gas (LNG) product. In particular, the present invention relates to optimized refrigeration processes and systems for cooling the incoming gas. As described in further detail below, the incoming feed gas stream can be cooled and at least partially condensed with a closed-loop refrigeration system employing a single mixed refrigerant. According to various embodiments of the present invention, the refrigeration system may be optimized to provide efficient cooling for the feed gas stream, while minimizing the expenses associated with the equipment and operating costs of the facility.

Figure 1:
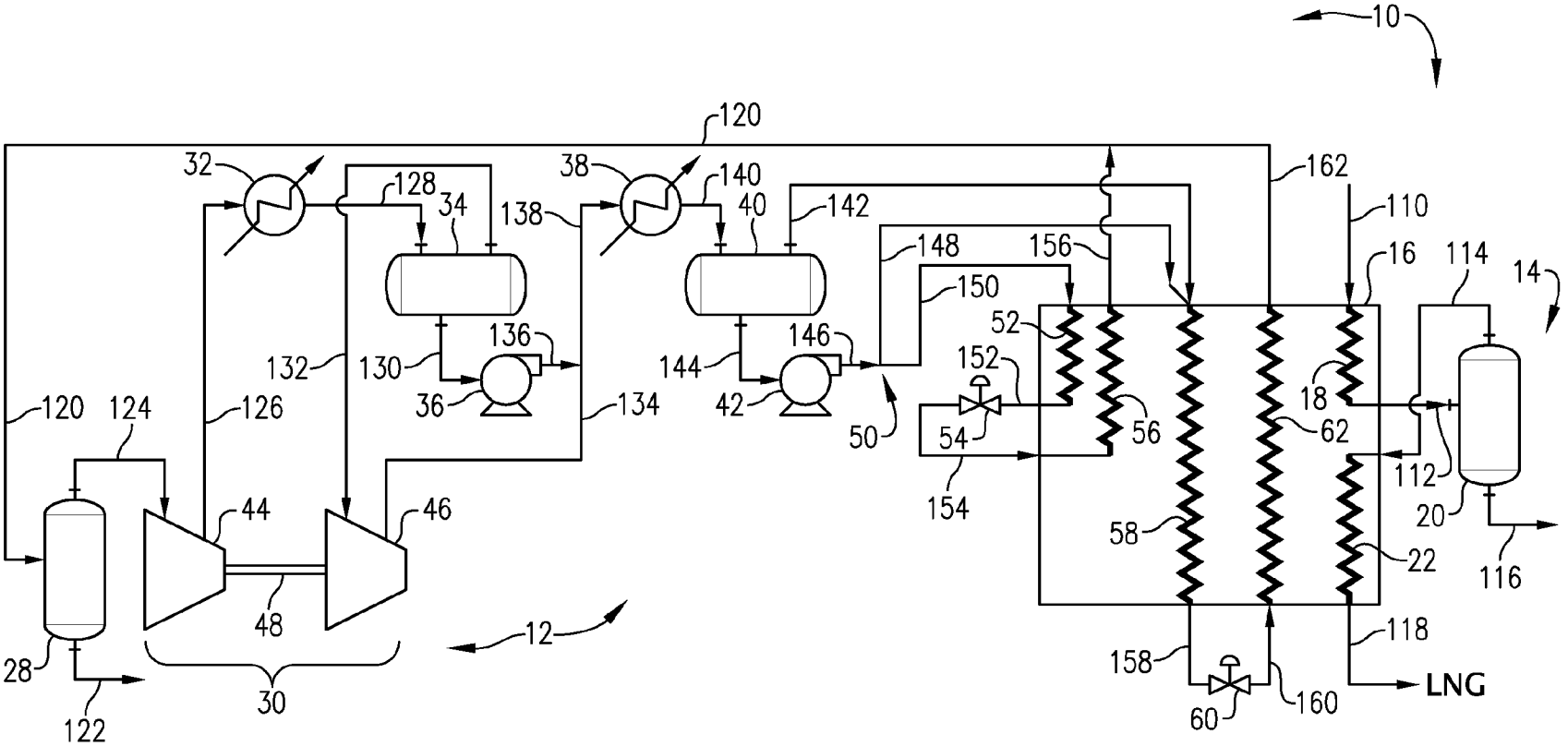
FIG. 1 provides a schematic depiction of a liquefied natural gas (LNG) facility configured according to one embodiment of the present invention, particularly illustrating an optimized mixed refrigerant system.

Referring initially to FIG. 1, one embodiment of an LNG production facility 10 is illustrated as comprising a closed-loop, mixed refrigerant refrigeration system 12 and a gas separation zone 14. As shown in FIG. 1, the incoming feed gas stream in conduit 110 can be cooled and at least partially condensed in a primary heat exchanger 16 of refrigeration cycle 12 before being separated and further cooled in gas separation zone 14 to provide the LNG product. Additional details regarding the configuration and operation of LNG facility 10, according to various embodiments of the present invention, are described below with reference to FIG. 1.

As shown in FIG. 1, a feed gas stream can be introduced into LNG facility 10 via conduit 110. The incoming gas stream in conduit 110 can be any gas stream requiring cooling and, in some embodiments, can be a natural gas feed stream originating from one or more gas sources (not shown). Examples of suitable gas sources can include, but are not limited to, natural sources such as, subterranean formations and petroleum production wells, and/or refining units such as fluidized catalytic crackers, petroleum cokers, or heavy oil processing units, such as oil sands upgraders. Depending on the origin and composition of the feed gas stream, LNG facility 10 can include one or more additional processing units or zones (not shown) upstream of primary heat exchanger 16 for removing unwanted components such as water, sulfur, mercury, nitrogen, and heavy ($C_6^+$) hydrocarbon materials from the feed gas stream prior to its liquefaction.

According to one embodiment, the feed gas stream in conduit 110 can comprise at least about 65, at least about 75, at least about 85, at least about 95, at least 99 weight percent methane, based on the total weight of the stream. Typically, heavier components such as $C_2$, $C_3$, and heavier hydrocarbons, and trace amounts of components such as hydrogen and nitrogen, can make up the balance of the composition fo the feed gas stream. As discussed previously, the stream in conduit 110 may have undergone one or more pretreatment steps to reduce the amount of or remove one or more components other than methane from the feed gas stream. In one embodiment, the feed gas stream in conduit 110 comprises less than about 25, less than about 20, less than about 15, less than about 10, or less than about 5 percent of components other than methane. Depending on the source and composition of the feed gas stream, the undesired components removed in the pretreatment steps can include, but are not limited to, water, mercury, sulfur compounds, and other materials.

As shown in FIG. 1, the feed gas stream in conduit 110 can be introduced into a first cooling pass 18 of a primary heat exchanger 16, wherein the stream may be cooled and at least partially condensed via indirect heat exchange with at least one yet-to-be-discussed stream of mixed refrigerant. Terms such as "first," "second," and "third," are used herein and in the appended claims to describe various elements of systems and processes of the present invention, and such elements should not be limited to by these terms. These terms are only used to distinguish one element from another and do not necessarily imply a specific order or even a specific element. For example, an element may be regarded as a "first" element in the description and a "second element" in the claims without departing from the scope of the present invention. Consistency is maintained within the description and each independent claim, but such nomenclature is not necessarily intended to be consistent therebetween.

Primary heat exchanger 16 shown in FIG. 1 can be any type of heat exchanger, or a series of heat exchangers, operable to cool and at least partially condense the feed gas stream in conduit 110. For example, in some embodiments, primary heat exchanger 16 can be a brazed aluminum heat exchanger comprising a plurality of warming and cooling passes (e.g., cores) disposed within the exchanger configured to facilitate indirect heat exchange between one or more process streams and one or more refrigerant streams. In some embodiments, one or more of the warming and/or cooling passes may be alternately defined between a plurality of plates disposed within the external "shell" of exchanger 16. It should be understood that, although generally illustrated in FIG. 1 as comprising a single shell, primary heat exchanger 16 may, in some embodiments, comprise two or more separate shells optionally encompassed by a "cold box" to minimize heat loss to the surrounding environment. Other types or configurations of primary heat exchanger 16 may also be suitable and are contemplated to be within the scope of the present invention.

Referring back to FIG. 1, the cooled, two-phase stream withdrawn from cooling pass 18 of primary heat exchanger 16 via conduit 112 may subsequently be introduced into a vapor-liquid separator 20. Separator 20 can be any suitable type of vapor-liquid separation vessel and may include any number of actual or theoretical separation stages. In one embodiment, vapor-liquid separation vessel may comprise a single separation stage, while, in other embodiments, separation vessel 20 can include at least about 2, at least about 5, at least about 10 and/or not more than about 50, not more than about 40, not more than about 25 actual or theoretical separation stages. Separator 20 may include any suitable type of column internals, including, for example, mist eliminators, mesh pads, vapor-liquid contacting trays, random packing, and/or structured packing in order to facilitate heat and/or mass transfer between the vapor and liquid streams. In some embodiments, when separator 20 comprises a single-stage separation vessel, few or no column internals may be employed. Additionally, gas separation zone 14 may include one or more other separation vessels (not shown) arranged in parallel or in series with separator 20. When gas separation zone 14 includes one or more additional vapor-liquid separators, each of the additional separators may configured similarly to or different than separator 20.

As shown in FIG. 1, separator 20 can separate the two-phase fluid stream in conduit 112 into an overhead vapor stream in conduit 114 and a bottoms liquid stream in conduit 116. Typically, the overhead vapor stream withdrawn from separator 20 via conduit 114 may be enriched in methane and lighter components, while the bottoms liquid stream in conduit 116 may be a methane-depleted stream enriched one or more heavier components, such as ethane, propane, and others. In some embodiments, the bottoms liquid stream in conduit 116 may be recovered as a separate natural gas liquids (NGL) product stream and may be subjected to further downstream processing and/or separation (not shown).

As shown in one embodiment depicted in FIG. 1, the overhead vapor stream withdrawn from separator 20 via conduit 114 may be routed into a second natural gas cooling pass 22 of primary heat exchanger 16. In cooling pass 22, the cooled gas stream may be further cooled, condensed, and optionally sub-cooled, via indirect heat exchange with one or more yet-to-be-discussed refrigerant streams. As shown in FIG. 1, the resulting sub-cooled LNG product stream may be withdrawn from primary heat exchanger 16 via conduit 118. In some embodiments, the LNG product stream in conduit 118 may have a temperature in the range of from about −200° F. to about −290° F., about −220° F. to about −280° F., or about −240° F. to about −275° F. and/or a pressure of less than about 50 psia, less than about 40 psia, less than about 30 psia, or less than about 20 psia. Although not illustrated in FIG. 1, LNG facility 10 may also include additional processing units and/or storage facilities downstream of primary heat exchanger 16 to further process, separate, and/or store the LNG product stream in conduit 118. In some embodiments, at least a portion of the LNG product may be transported from LNG facility 10 to one or more separate facilities (not shown) for subsequent storage, processing, and/or use.

Turning now the embodiment of refrigeration system 12 of LNG facility 10 depicted in FIG. 1, refrigeration cycle 12 illustrated as generally including a refrigerant suction drum 28, a multi-stage refrigerant compressor 30, an interstage cooler 32, an interstage accumulator 34, an interstage refrigerant pump 36, a refrigerant condenser 38, a refrigerant accumulator 40, and a refrigerant pump 42. Additionally, refrigeration system 12 includes a pair of refrigerant cooling passes 52 and 58 and a pair of refrigerant warming passes 56 and 62, each having an expansion device 54 and 60, respectively disposed between cooling pass 52 and warming pass 56 and cooling pass 58 and warming pass 62.

According to one embodiment of the present invention, the refrigerant utilized in closed-loop refrigeration cycle 12 may be a mixed refrigerant. As used herein, the term "mixed refrigerant" refers to a refrigerant composition comprising two or more constituents. In one embodiment, the mixed refrigerant utilized by refrigeration cycle 12 may be a single mixed refrigerant and can comprise two or more components selected from the group consisting of methane, ethylene, ethane, propylene, propane, isobutane, n-butane, isopentane, n-pentane, and combinations thereof. In some embodiments, the refrigerant composition can comprise methane, ethane, propane, normal butane, and isopentane and can exclude certain components, including, for example, nitrogen or halogenated hydrocarbons. Various specific refrigerant compositions are contemplated according to embodiments of the present invention. Table 1, below, summarizes broad, intermediate, and narrow ranges for several exemplary components that may be employed in refrigerant mixtures suitable for use in refrigerant cycle 12, according to various embodiments of the present invention.

TABLE 1

Exemplary Mixed Refrigerant Compositions

| Component | Broad Range, mole % | Intermediate Range, mole % | Narrow Range, mole % |
|---|---|---|---|
| methane | 0 to 50 | 5 to 40 | 10 to 30 |
| ethylene | 0 to 50 | 5 to 40 | 10 to 30 |
| ethane | 0 to 50 | 5 to 40 | 10 to 30 |
| propylene | 0 to 50 | 5 to 40 | 5 to 30 |
| propane | 0 to 50 | 5 to 40 | 5 to 30 |
| i-butane | 0 to 10 | 0 to 5 | 0 to 2 |
| n-butane | 0 to 25 | 1 to 20 | 5 to 15 |
| i-pentane | 0 to 30 | 1 to 20 | 2 to 15 |
| n-pentane | 0 to 10 | 0 to 5 | 0 to 2 |
| nitrogen | 0 to 30 | 0 to 25 | 0 to 20 |

In some embodiments of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed gas stream introduced into LNG facility 10. In one embodiment, the composition of the mixed refrigerant can be adjusted such that the heating curve of the vaporizing refrigerant more closely matches the cooling curve of the feed gas stream. One method for such curve matching is described in detail in U.S. Pat. No. 4,033,735, the disclosure of which is incorporated herein by reference in its entirety and to the extent not inconsistent with the present disclosure. In some embodiments, ability to alter the composition and, consequently, the heating curve of the refrigerant provides increased flexibility and operability to the facility, enabling it to receive and efficiently process feed streams having a wider variety of gas compositions.

Referring again to refrigeration cycle 12 shown in the embodiment of facility 10 in FIG. 1, a stream of mixed refrigerant in conduit 120 may be introduced into a fluid inlet of refrigerant suction drum 28, wherein any liquid present may be separated from the vapor phase. When present, the liquids may then be withdrawn from a lower liquid outlet of suction drum 28 and can be returned to the circulating system (not shown). As shown in FIG. 1, a vapor phase stream of mixed refrigerant can be withdrawn from an upper vapor outlet of suction drum 28 and routed to a low pressure inlet of a low pressure compression stage 44 of multi-stage compressor 30. Multi-stage compressor 30 may be any type of compressor suitable to increase the pressure of the mixed refrigerant in closed-loop mixed refrigeration cycle 12. Although illustrated in FIG. 1 as generally comprising two compression stages, multi-stage compressor 30 may include three or more stages, in accordance with other embodiments of the present invention.

As shown in FIG. 1, the compressed refrigerant stream withdrawn from the intermediate pressure outlet of low pressure compression stage 44 of refrigerant compressor 30 via conduit 126 can be routed to the warm fluid inlet of interstage cooler 32, wherein the stream can be cooled and at least partially condensed via indirect heat exchange with at least one coolant stream (e.g., air or cooling water). The resulting two-phase refrigerant stream in conduit 128 can then be routed to an interstage accumulator 34, wherein the vapor and liquid phases may be separated. As shown in FIG. 1, the vapor stream withdrawn from interstage accumulator 34 via conduit 132 can be introduced into an intermediate pressure inlet of a high pressure compression stage 46 of multi-stage compressor, which can be connected to low pressure compression stage 44 via shaft 48. In high pressure compression stage 46, the mixed refrigerant stream may be further compressed before being discharged from a high-pressure outlet of high pressure compression stage 46 into conduit 134. Additionally, as depicted in the embodiment shown in FIG. 1, the liquid portion of the refrigerant stream withdrawn from interstage accumulator 34 via conduit 130 may be pumped to a higher pressure via refrigerant pump 36, before being combined with the compressed refrigerant stream in conduit 134. In one embodiment, the pressure of the liquid stream discharged from refrigerant pump 36 in conduit 136 can be within about 100, within about 50, within about 20, within about 10, or within about 5 psi of the pressure of the vapor stream in conduit 134 prior to combination of the two streams.

The combined refrigerant stream in conduit 138 can then be introduced into a refrigerant condenser 38, wherein the stream may be cooled and at least partially condensed via indirect heat exchange with a coolant stream (e.g., cooling water). The resulting cooled, at least partially condensed refrigerant stream in conduit 140 may then be introduced into a refrigerant accumulator 40, wherein the vapor and liquid phases may be separated. As shown in FIG. 1, the vapor phase refrigerant stream in conduit 142 may be withdrawn and combined with a yet-to-be-discussed liquid refrigerant stream before being introduced into primary heat exchanger 16.

According to one embodiment of the present invention, the liquid refrigerant stream withdrawn from refrigerant accumulator 40 via conduit 144 can be pressurized via refrigerant pump 40 and the resulting stream discharged into conduit 146 may be passed through a dividing device 50, which can be configured to divide the pressurized liquid refrigerant into two separate portions in conduits 148 and 150. As shown in FIG. 1, dividing device 50 is not a vapor-liquid separator, but, instead, can be any device configured to divide the liquid stream in conduit 146 into two streams of similar composition and state. The flow rates of the individual streams in conduits 148 and 150 may be similar or different. For example, in some embodiments, the ratio of the mass flow rate of the stream in conduit 148 to the mass flow rate of the stream in conduit 150 can be at least about 0.5:1, at least about 0.75:1, at least about 0.95:1 and/or not more than about 2:1, not more than about 1.75:1, not more than about 1.5:1, not more than about 1.25:1. In the same or other embodiments, the ratio of the mass flow rate of the stream in conduit 148 to the mass flow rate of the stream in conduit 150 can be approximately 1:1.

As shown in FIG. 1, the first portion of the liquid refrigerant stream in conduit 148 may be combined with the vapor phase refrigerant stream withdrawn from refrigerant accumulator 40 in conduit 142. The amount of vapor and/or liquid introduced into conduits 142 and/or 148 may be controlled to achieve a desired ratio of vapor to liquid introduced into a refrigerant cooling pass 58 disposed within primary heat exchanger 16. In one embodiment, the combined stream introduced into cooling pass 58 can have a vapor fraction of at least about 0.45, at least about 0.55, at least about 0.65 and/or not more than about 0.95, not more than about 0.90, not more than about 0.85. Although illustrated as being combined just prior to introduction into cooling pass 58, it should be understood that the liquid stream in conduit 148 and the vapor phase refrigerant stream in conduit 142 may be alternatively be combined within primary heat exchanger 16 or may be combined at a different location further upstream of heat exchanger 16, so that the combined stream may be introduced into cooling pass 58 via a common conduit external to primary heat exchanger 16 (embodiment not shown in FIG. 1).

As shown in FIG. 1, the combined refrigerant stream introduced into primary heat exchanger 16 descends vertically downward through cooling pass 58, wherein it can be cooled and condensed via indirect heat exchange with one or more refrigerant streams. The resulting condensed and subcooled liquid stream can be withdrawn from the lower portion of primary heat exchanger 16 via conduit 158. As shown in FIG. 1, the liquid refrigerant stream in conduit 158 may then be passed through an expansion device 60, wherein the pressure of the stream can be reduced to thereby flash a portion thereof. The resulting cooled, two-phase stream in conduit 160 can then be introduced into refrigerant warming pass 62, wherein the stream may be warmed as it ascends vertically upwardly through primary heat exchanger 16. As the ascending refrigerant stream is warmed, it can provide refrigeration to one or more of the streams being cooled, as described previously.

According to one embodiment of the present invention, the second portion of the liquid refrigerant stream withdrawn from refrigerant accumulator 40 via conduit 150 can be separately introduced into a second refrigerant cooling pass 52 disposed within primary heat exchanger 16. As the liquid stream travels vertically downward through cooling pass 52, it is cooled and condensed via indirect heat exchange with one or more refrigerant streams. The resulting liquid refrigerant stream exiting cooling pass 52 in conduit 152 can then be passed through expansion device 54, wherein the pressure of the stream can be reduced to thereby flash a portion of the stream. Although generally depicted as being an expansion valve or Joule-Thompson (JT) valve in FIG. 1, it should also be understood that expansion device 54 may comprise any suitable type of expander, including, for example, a JT orifice or a turboexpander (not shown). Similarly, expansion device 54 may include, in some embodiments, two or more expansion devices, arranged in parallel or in series, configured to reduce the pressure of the liquid refrigerant stream in conduit 152.

The resulting cooled, two-phase refrigerant stream in conduit 154 may then be reintroduced into another refrigerant warming pass 56 of primary heat exchanger 16, wherein the stream can be warmed to thereby providing refrigeration to one or more other fluid streams being cooled in primary heat exchanger 16, including the refrigerant streams in conduits 150 and 158 in respective cooling passes 52 and 58, the natural gas feed stream in conduit 110 in cooling pass 18, and/or the overhead vapor stream in conduit 114 in cooling pass 22.

According to one embodiment depicted in FIG. 1, the overall length of refrigerant cooling pass 52 can be less than the overall length of refrigerant cooling pass 58. Consequently, the cooled refrigerant stream exiting refrigerant cooling pass 52 via conduit 152 may be withdrawn from a higher vertical elevation along the height of primary heat exchanger 16 than the cooled refrigerant stream withdrawn from refrigerant cooling pass 58. For example, in one embodiment depicted in FIG. 1, the cooled refrigerant stream exiting refrigerant cooling pass 52 may be withdrawn from a vertical mid-point of primary exchanger 16, while the cooled refrigerant stream exiting refrigerant cooling pass 58 may be withdrawn from an outlet positioned near the lower vertical end of primary exchanger 16. According to one embodiment, the ratio of the total length of refrigerant cooling pass 52 to the total length of refrigerant cooling pass 58 can be at least about 0.15:1, at least about 0.25:1, at least about 0.35:1 and/or not more than about 0.75:1, not more than about 0.65:1, not more than about 0.50:1, or in the range of from about 0.15:1 to about 0.75:1, about 0.25:1 to about 0.65:1, or about 0.25:1 to about 0.50:1. In the same or other embodiments, the ratio of the total length of refrigerant cooling pass 52 to the overall height (i.e., vertical dimension) of primary heat exchanger 16 can be at least about 0.15:1, at least about 0.25:1, at least about 0.35:1 and/or not more than about 0.75:1, not more than about 0.65:1, not more than about 0.55:1, while the ratio of the total length of cooling pass 58 to the overall height of primary heat exchanger 16 can be about 1:1.

As shown in FIG. 1, a first warmed mixed refrigerant stream, which may have a vapor fraction of at least about 0.85, at least about 0.90, at least about 0.95, can be withdrawn from warming pass 62 via conduit 162 and a second warmed refrigerant stream having a similar vapor fraction may be withdrawn from warming pass 58 via conduit 156. According to one embodiment depicted in FIG. 1, the two streams of warmed refrigerant stream may then be combined and the resulting stream in conduit 120 may thereafter be recirculated to the inlet of refrigerant suction drum 28, as described in detail previously.

Figure 2:
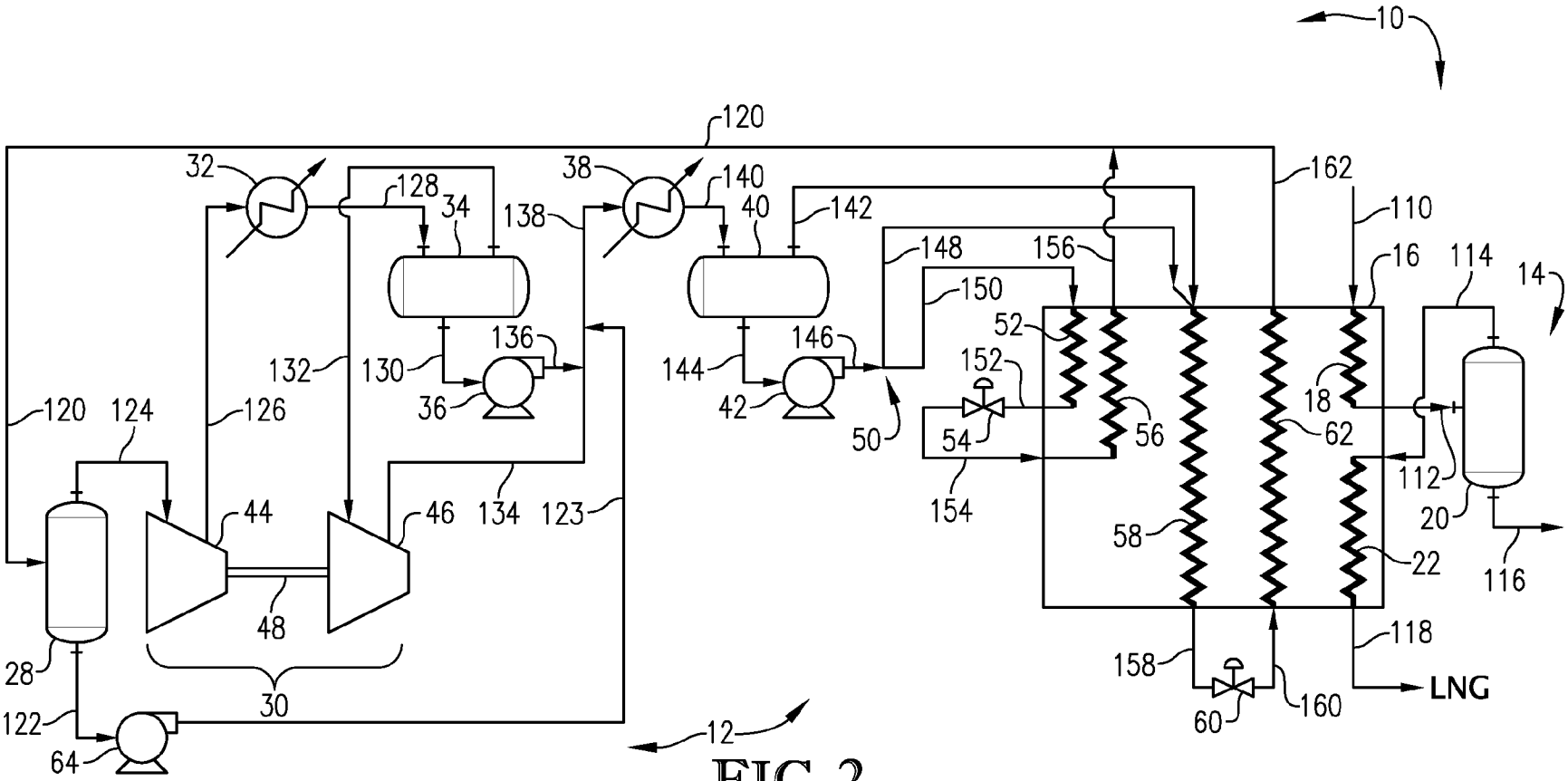
FIG. 2 provides a schematic depiction of a liquefied natural gas (LNG) facility configured according to another embodiment of the present invention, similar to the embodiment depicted in FIG. 1, but including a method for recycling refrigerant liquids.

Turning now to FIG. 2, another embodiment of LNG facility 10 is illustrated. The embodiment of LNG facility 10 shown in FIG. 2 is similar to the embodiment depicted in FIG. 1, but includes a different configuration of various components of refrigeration system 12. The main components of LNG facility 10 shown in FIG. 2 are numbered the same as those depicted in FIG. 1. The operation of LNG facility 10 illustrated in FIG. 2, as it differs from that previously discussed with respect to FIG. 1, will now be described in detail below.

As shown in FIG. 2, the stream of mixed refrigerant in conduit 120 introduced into refrigerant suction drum 28 can be separated into an overhead vapor stream in conduit 124 and a bottoms liquid stream in conduit 122. According to the embodiment depicted in FIG. 2, the bottoms liquid stream in conduit 122 withdrawn from refrigerant suction drum 28 can be pressurized via a refrigerant pump 64 and the resulting stream in conduit 123 may then be combined with the two-phase refrigerant stream in conduit 138. Thereafter, the combined refrigerant stream in conduit 138 can be introduced into refrigerant condenser 38 and the resulting cooled stream can then pass through the remainder of refrigeration cycle 12, as discussed in detail previously with respect to FIG. 1. In one embodiment (not shown in FIG. 2), it may be possible to combine the pressurized liquid bottoms stream in conduit 123 with the compressed vapor refrigerant stream exiting the high pressure compression stage 46 in conduit 134 to produce a combined stream, which can subsequently be combined with the pressurized liquid phase refrigerant stream discharged from interstage pump 36 in conduit 136.

According to one embodiment, the addition of refrigerant pump 64 to the lower liquid conduit 122 of refrigeration suction drum 28 may permit refrigeration cycle 12 to utilize refrigerants having different compositions than those suitable for use in the embodiment of LNG facility 10 shown in FIG. 1. In particular, the employment of a refrigeration liquid recycle conduit 123 as shown in the embodiment of LNG facility 10 depicted in FIG. 2, may allow refrigeration cycle 12 to employ a mixed refrigerant that includes a higher concentration of heavy hydrocarbons than the mixed refrigerant utilized in LNG facility 10 shown in FIG. 1. As described previously, it may be desirable to alter the composition of the mixed refrigerant employed in refrigeration cycle 12 to, for example, accommodate changes in composition of the feed gas stream and more closely match the heating curve of the mixed refrigerant with the cooling curve of the natural gas stream. In some embodiments, the option to utilize mixed refrigerants of varying composition, including those refrigerant compositions including a higher amount of heavier components, may impart even more operating flexibility to LNG facilities configured according to embodiments of the present invention.

Figure 3:
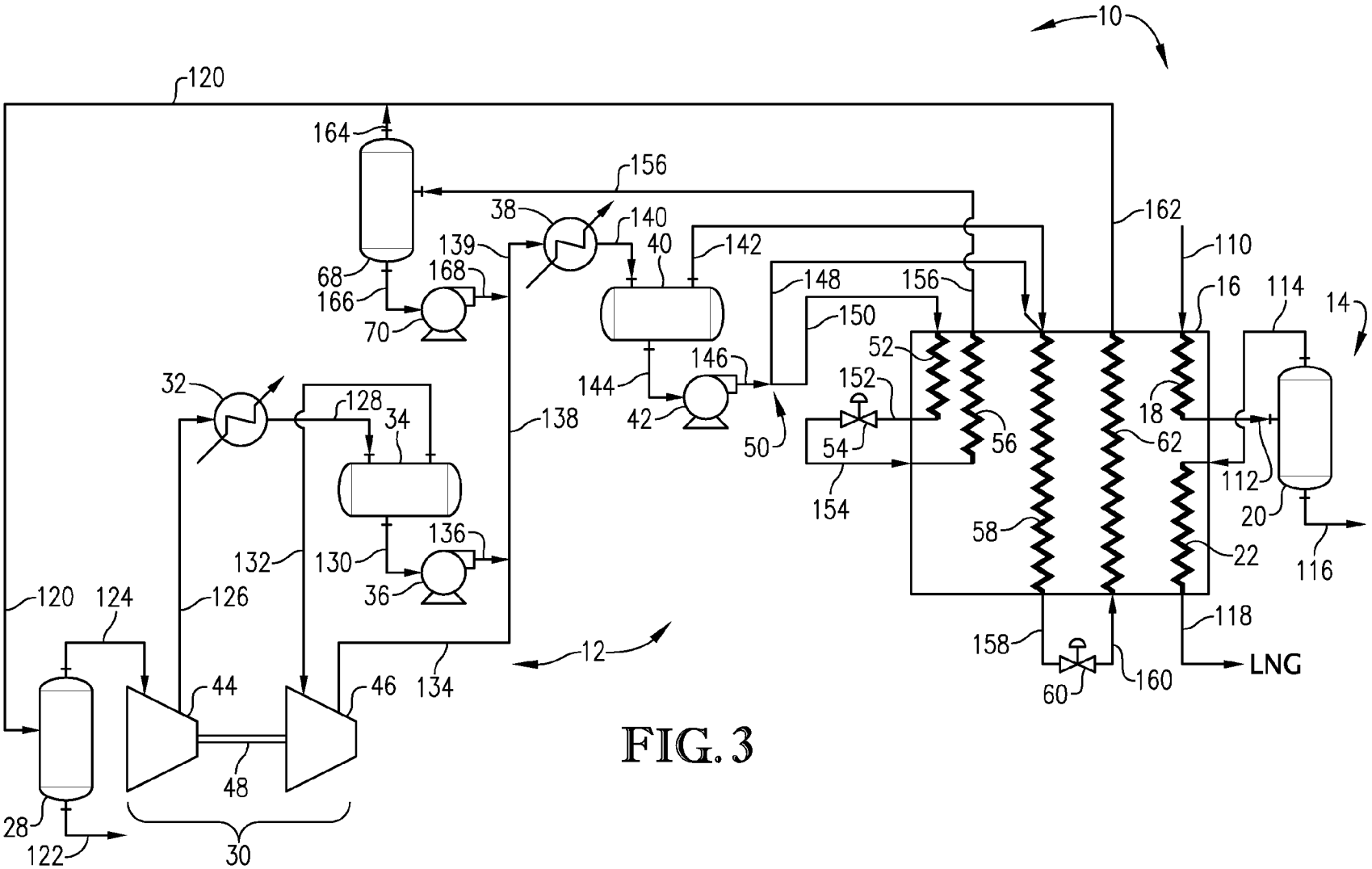
FIG. 3 provides a schematic depiction of a liquefied natural gas (LNG) facility configured according to another embodiment of the present invention, similar to the embodiment depicted in FIG. 1, but including another method for recycling refrigerant liquids.

Turning now to FIG. 3, yet another embodiment of LNG facility 10 is illustrated. The embodiment of LNG facility 10 shown in FIG. 3 is similar to the embodiment depicted in FIG. 1, but includes a different configuration of various components of refrigeration system 12. The main components of LNG facility 10 shown in FIG. 3 are numbered the same as those depicted in FIG. 1. The operation of LNG facility 10 illustrated in FIG. 3, as it differs from that previously discussed with respect to FIG. 1, will now be described.

As shown in FIG. 3, two streams of warmed mixed refrigerant can be withdrawn from refrigerant warming pass 56 and refrigerant warming pass 62 via respective conduits 156 and 162. Rather than being combined, as shown in the embodiment depicted in FIG. 1, the warmed refrigerant streams in conduits 156 and 162 remain separate as shown in the embodiment of LNG facility 10 shown in FIG. 3. As shown in FIG. 3, the warmed refrigerant vapor stream in conduit 156, which may have a temperature that is at least about 25° F., at least about 50° F., at least about 75° F. and/or not more than about 150° F., not more than about 125° F., not more than about 100° F. warmer than the warmed refrigerant vapor stream in conduit 162, may be routed to a fluid inlet of a refrigerant separator 68, wherein the vapor and liquid portions may be separated from each other. Refrigerant separator 68 may be any suitable type of vapor-liquid separator and can optionally include one or more tower internals described in detail previously with respect to separator 20.

As shown in FIG. 3, the liquid portion of the warmed refrigerant stream introduced into refrigerant separator 68 may be withdrawn from separator 68 via conduit 166 and pumped to a higher pressure via a refrigerant pump 70. The resulting, pressurized stream of liquid refrigerant in conduit 168 may then be combined with the previously-discussed two-phase pressurized refrigerant stream in conduit 138. The resulting combined refrigerant stream in conduit 139 may then be introduced into refrigerant condenser 38, wherein the stream can be cooled and at least partially condensed before continuing through the remaining portions of refrigeration cycle 12 as described previously with respect to FIG. 1.

Referring again to FIG. 3, the vapor portion of the warmed refrigerant stream introduced into refrigerant separator 68 may be withdrawn from the upper portion of separator 68 via conduit 164 and combined with the second warmed refrigerant stream withdrawn from refrigerant warming pass 62 in conduit 162. The resulting combined vapor-phase refrigerant stream in conduit 120 can then be routed to the inlet of refrigerant suction drum 28, wherein the stream may be separated into vapor and liquid portions withdrawn from drum 28 via respective conduits 124 and 122, as shown in FIG. 3. Thereafter, each of the vapor and liquid portions may continue through the remainder of refrigeration cycle 12 as discussed in detail previously with respect to FIG. 1.

Although described herein with respect to liquefying a natural gas stream, it should it should also be understood that processes and systems of the present invention may also be suitable for use in other gas processing and separation applications, including, but not limited to, ethane recovery and liquefaction, recovery of natural gas liquids (NGL), syngas separation and methane recovery, and cooling and separation of nitrogen and/or oxygen from various hydrocarbon-containing gas streams.

The preferred forms of the invention described above are to be used as illustration only, and should not be used in a limiting sense to interpret the scope of the present invention. Obvious modifications to the exemplary one embodiment, set forth above, could be readily made by those skilled in the art without departing from the spirit of the present invention. The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for producing liquefied natural gas (LNG), said process comprising:

(a) cooling a natural gas stream in a first heat exchanger to provide a cooled natural gas stream;

(b) compressing a mixed refrigerant stream to provide a compressed refrigerant stream;

(c) cooling and at least partially condensing the compressed refrigerant stream to provide a two-phase refrigerant stream;

(d) separating the two-phase refrigerant stream into a first refrigerant vapor stream and a first refrigerant liquid stream in a first vapor-liquid separator;

(e) combining at least a portion of the first refrigerant vapor stream withdrawn from the first vapor-liquid separator with at least a portion of the first refrigerant liquid stream to provide a combined refrigerant stream;

(f) cooling at least a portion of the combined refrigerant stream to provide a cooled combined refrigerant stream;

(g) separating the cooled combined refrigerant stream into a second refrigerant vapor stream and a second refrigerant liquid stream in a second vapor-liquid separator;

(h) dividing the second refrigerant liquid stream into a first refrigerant liquid fraction and a second refrigerant liquid fraction;

(i) cooling at least a portion of the first and second refrigerant liquid fractions in separate first and second refrigerant cooling passes disposed within the first heat exchanger to provide respective first and second cooled liquid refrigerant fractions;

(i) withdrawing the first and second cooled liquid refrigerant fractions from the respective first and second refrigerant cooling passes;

(k) introducing the first and second cooled liquid refrigerant fractions into separate inlets of the first heat exchanger;

(l) warming each of the first and second cooled liquid refrigerant fractions in respective first and second refrigerant warming passes disposed within the first heat exchanger, wherein the warming of each of the first and second cooled liquid refrigerant fractions is used to carry out at least a portion of the cooling of step (a);

(m) withdrawing first warmed refrigerant fraction and second warmed refrigerant fractions from respective first and second warming passes disposed within the first heat exchanger; and (n) prior to said compressing of step (b), combining at least a portion of the first and second warmed refrigerant fractions withdrawn from the first heat exchanger to provide a combined warmed refrigerant stream, wherein the mixed refrigerant stream compressed in step (b) comprises at least a portion of said combined warmed refrigerant stream; further comprising, prior to said compressing of step (b), separating the combined warmed refrigerant stream in a third vapor-liquid separator to provide a vapor phase mixed refrigerant stream and a liquid phase mixed refrigerant stream, wherein the mixed refrigerant stream compressed in step (b) comprises at least a portion of the vapor phase mixed refrigerant stream withdrawn from the third vapor-liquid separator.

2. The process of claim 1, further comprising, combining at least a portion of the liquid phase mixed refrigerant stream withdrawn from the third vapor-liquid separator with at least a portion of the combined refrigerant stream prior to the cooling of step (f).

3. The process of claim 1, further comprising, prior to said combining of step (n), separating the first warmed refrigerant fraction into a first warmed refrigerant vapor stream and a first warmed refrigerant liquid stream in a fourth vapor-liquid separator, wherein the mixed refrigerant stream compressed in step (b) comprises at least a portion of the first warmed refrigerant vapor stream.

4. The process of claim 3, further comprising, combining the first warmed refrigerant vapor stream with the second warmed refrigerant fraction to provide a combined refrigerant vapor stream, wherein the mixed refrigerant stream compressed in step (b) comprises at least a portion of the combined refrigerant vapor stream.

5. The process of claim 3, further comprising, combining at least a portion of the first warmed refrigerant liquid stream with at least a portion of the combined refrigerant stream prior to the cooling of step (f).

6. The process of claim 1, further comprising, compressing at least a portion of the first refrigerant vapor stream withdrawn from the first vapor-liquid separator to provide a first compressed refrigerant vapor stream, wherein the first refrigerant vapor stream combined with the first refrigerant liquid stream in step (e) comprises the first compressed refrigerant vapor stream.

7. The process of claim 1, further comprising expanding the first and second cooled liquid refrigerant fractions to provide respective first and second expanded refrigerant fractions, wherein the first and second cooled liquid refrigerant fractions introducing into the first heat exchanger in step (k) comprise respective first and second expanded refrigerant fractions.

8. The process of claim 7, wherein at least a portion of the cooling of step (i) is carried out via indirect heat exchange with at least a portion of the first and second expanded refrigerant fractions.

9. The process of claim 1, further comprising, combining at least a portion of the second refrigerant vapor stream with the second refrigerant liquid fraction to provide a second combined refrigerant stream, wherein said second refrigerant liquid fraction cooled in step (i) comprises the second combined refrigerant stream.

10. The process of claim 1, further comprising, separating the cooled natural gas stream into a methane-rich vapor stream and a methane-depleted liquid stream and cooling at least a portion of the methane-rich vapor stream in the first heat exchanger to provide a stream of liquefied natural gas, wherein at least a portion of the cooling of the methane-rich vapor stream is carried out via indirect heat exchange with at least one of the first and the second cooled liquid refrigerant fractions.

11. The process of claim 1, further comprising prior to said dividing of step (h), increasing the pressure of the second refrigerant liquid stream with a refrigerant pump to provide a pressurized liquid refrigerant stream, wherein the second refrigerant liquid stream divided in step (h) includes the pressurized refrigerant liquid stream.

12. The process of claim 1, wherein the first cooled liquid refrigerant fraction is withdrawn from the first refrigerant cooling pass at a higher vertical elevation along the first heat exchanger than the second cooled liquid refrigerant fraction withdrawn from the second refrigerant cooling pass.

13. The process of claim 12, wherein the ratio of the total length of the first refrigerant cooling pass to the total length of the second refrigerant cooling pass is not more than about 0.75:1.

* * * * *